US005154432A

United States Patent [19]

Saunders

[11] Patent Number: 5,154,432

[45] Date of Patent: Oct. 13, 1992

[54] ARROW NOCK ORIENTATION ASSEMBLY

[75] Inventor: Charles A. Saunders, Columbus, Nebr.

[73] Assignee: Saunders Archery Company, Columbus, Nebr.

[21] Appl. No.: 850,919

[22] Filed: Mar. 13, 1992

[51] Int. Cl.[5] ..... F42B 6/06

[52] U.S. Cl. ..... 273/416

[58] Field of Search ..... 273/416

[56] References Cited

U.S. PATENT DOCUMENTS

| | | | |
|---|---|---|---|
| 2,664,078 | 12/1953 | Irwin | 273/416 X |
| 4,874,180 | 10/1989 | Fingerson et al. | 273/416 |
| 5,067,731 | 11/1991 | Bickel | 273/416 |

OTHER PUBLICATIONS

Archer's Bible 1966-1967, Mar. 1967, pp. 58, 59, 74.
Archery, Aug. 1973, p. 26.
Archery Sportshop Catalog, 9th ed. Dec. 1987, p. 14.

*Primary Examiner*—Paul E. Shapiro
*Attorney, Agent, or Firm*—Michael G. Berkman

[57] ABSTRACT

An adapter for placement between to intercouple an arrow shaft with a nock for reproducibly establishing a selectable preferred orientation between a reference vane on an arrow shaft and a bowstring-receiving slot of the arrow nock which is affixed on the arrow shaft at an end thereof. The adapter and the nock carry annular markers or a scale indicia, and the adapter and nock indicia are manually rotationally displacable with respect to one another to establish selectively and reproducibly desired annular orientational relationships between the plane of a shaft-carried reference vane and a plane defined by the bowstring slot in the arrow nock. The adapter may be tapered or otherwise adapted to accommodate nocks having diameters which are less than the size of the arrowshaft.

11 Claims, 2 Drawing Sheets

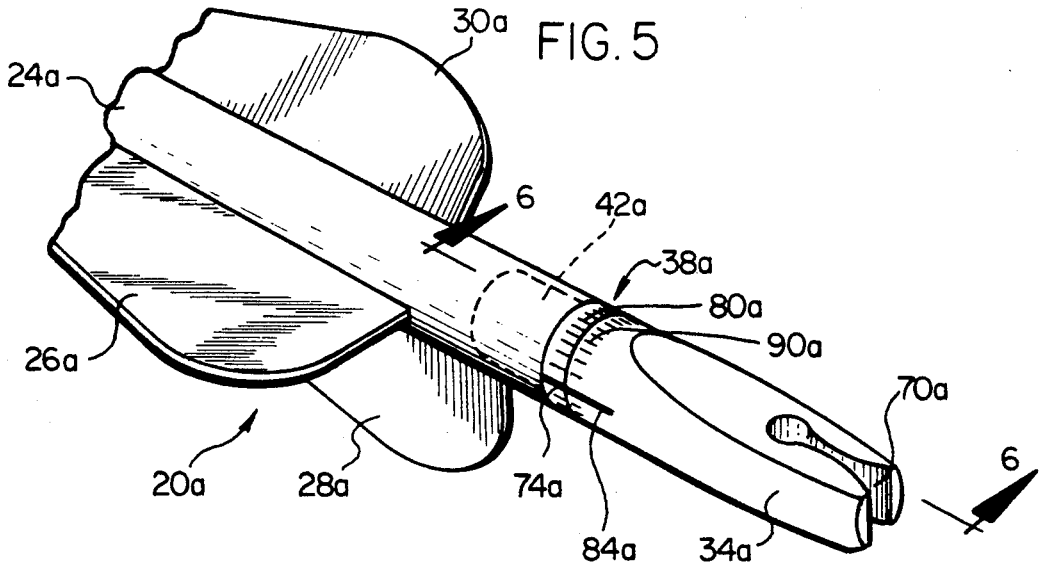
FIG. 5
FIG. 6
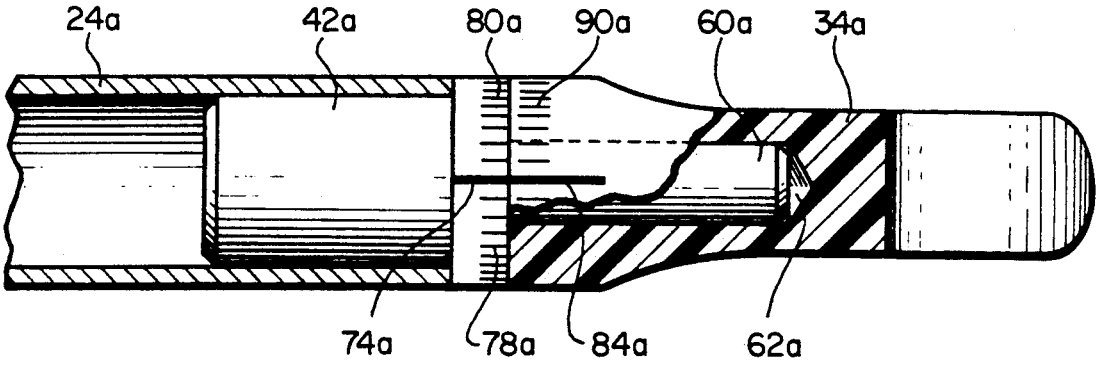
FIG. 7
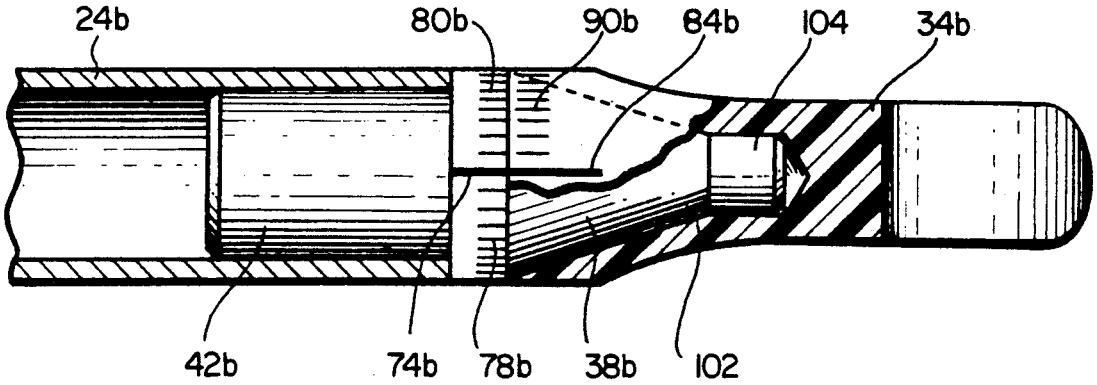

ARROW NOCK ORIENTATION ASSEMBLY

FIELD OF THE INVENTION, AND BACKGROUND

The present invention relates to an assembly for establishing a desired annular orientational mode between an arrow shaft and the bowstring-receiving slot of an arrow nock. More particularly, the invention is directed to a novel adapter to be interposed between and to intercouple an arrow shaft with a nock. The adapter enables one, selectively and reproducibly, to establish a preferred annular orientational relationship between a plane defined by a reference vane of an arrow shaft and a plane defined by the bowstring-receiving slot of an arrow nock.

As a first approximation, archers may orient the arrow nock on the arrow shaft so that the plane defined by the bowstring-receiving slot of the nock extends at 90° to a plane defined by a cock feather or reference vane of the arrow shaft. In many instances and for a given particular archer, it may be determined that this possibly idealized or somewhat arbitrary orientational relationship between the nock slot and the reference vane does not give the "truest" or most reliable arrow flight path or course.

Many archers prefer to use three fletch shafts with a reference vane or cock feather of a color which differs from the other two. A "proper" orientation of the feathers allows the arrow shaft to "whip around" the sight window without substantial mechanical interference. In the system referred to it has been a widespread practice among those archers who affix their own nocks or who replace nocks to use nocks which are indexed or marked. This indexing facilitates alighment of the slot of the nock at 90 degrees with reference to the plane of the cock feather or lead feather on the arrow shaft.

It has been found, in practice, however, that for individual archers true arrow flight may often be enhanced if the bowstring-receiving slot of the arrow nock is off-set somewhat from an exactly 90 degrees with respect to the plane of the lead feather of the arrow shaft.

For the most part, nocks presently available provide no means by which an intentional and purposeful, controlled and reproducible deviation from the arbitrary (though often useful) 90 degree orientation may be achieved.

It is to a rectification of the above indicated and other shortcomings of prior art, and to providing an effective method of attachment and orientation of nocks, as subjectively determined, that the present invention is directed.

It is the aim of the present invention to provide a simple apparatus and method by which an arrow nock may be secured to to an arrow shaft in selectable and readily reproducible orientational modes, with the plane of the bowstring slot being precisely normal to the plane of the reference vane or varying from normal by selectable and reproducible degrees of arc.

SUMMARY OF THE INVENTION

The present invention provides a simple device by which the nock of an archery arrow may be simply and quickly adjusted or indexed with respect to a reference vane, to a preferred position.

It is a feature of the present invention that an adapter interposed between an end of an arrow shaft and the arrow nock includes a reference marker or reference indicia which, in conjunction with cooperating indicia or a reference marker on the arrow nock enables the archer reproducibly to establish a preferred annular orientation between the bowstring-receiving slot of the arrow nock and the reference vane on the arrow shaft.

A related feature of the invention is that the arrow nock may be rotated to bring annularly disposed nock-carried indicia in registry with a reference marker carried by the adapter, and then secured in position.

An advantage of the adapter of the invention is that it facilitates the attachment of a nock diameter of a particular diameter to an arrow shaft having a different, or larger, diameter.

The adapter of the invention permits precise adjustments in the plane of the bowstring slot with respect to a plane defined by a reference vane or cock feather on the arrow shaft, to facilitate a "truing" of the arrow trajectory in flight.

Other and further objects and features of the invention are set forth in the following detailed description in which corresponding parts use the same numbers, but with a's and b's added.

BRIEF DESCRIPTION OF THE DRAWINGS

FIG. 5 is a perspective view similar to FIG. 1 but showing an embodiment of the invention in which the arrow shaft and the arrow nock are of the same diameter;

FIG. 6 is a cross-sectional view taken substantially on the lines 6—6 of FIG. 5 and showing the nock sleeved on a rod-like probe end of the adapter; and FIG. 7 is a cross-sectional view similar to FIG. 6 but showing an embodiment in which the adapter has a tapered frusto-conical intermediate lineal section which mates within a cooperating lineal cavity formed in the nock.

DETAILED DESCRIPTION OF ILLUSTRATED EMBODIMENTS

Figure 1:
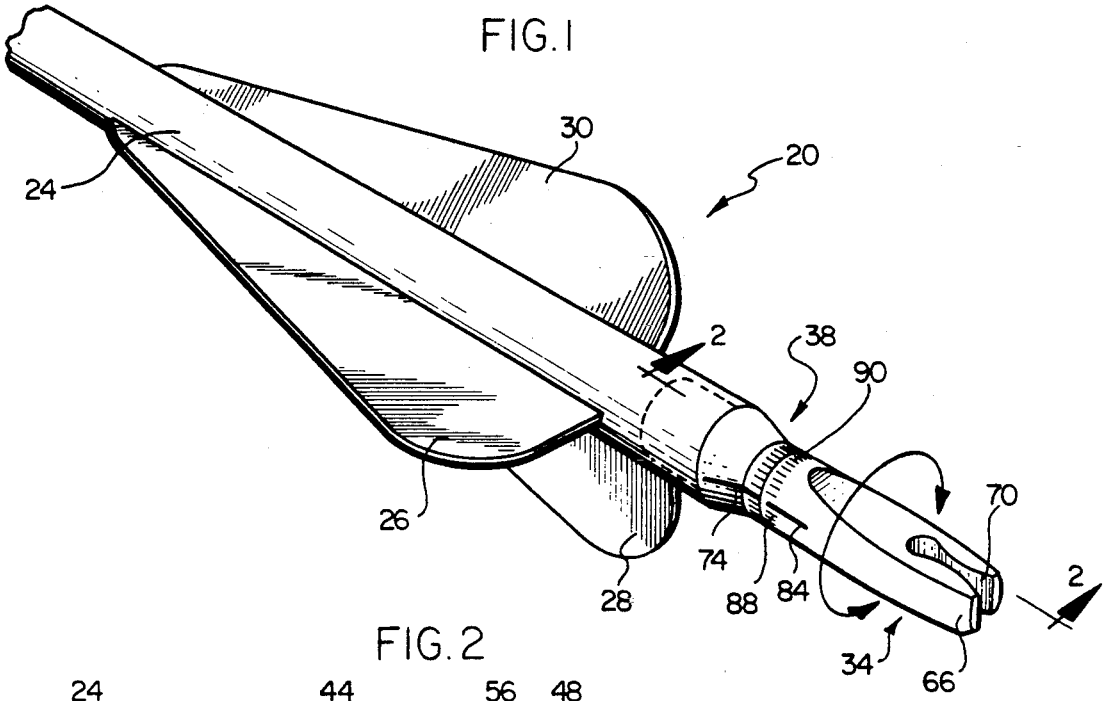
FIG. 1 is a fragmentary, perspective view of one embodiment of the invention showing an arrow shaft with an adapter, and a small diameter arrow nock, attached, and the scale indicia in the adapter and the nock, in accordance with the present invention.

The aims and objects of the invention are achieved by providing, for use in conjunction with an arrow shaft and a nock, an adapter as an interposed lineal coupler between the two. In a preferred embodiment of the invention, the adapter, which is fixedly secured with respect to the arrow shaft, carries marker indicia which include at least a lineally extending reference marker. That reference marker line or scribe is conveniently oriented to coincide with a plane defined by the cock feather or reference vane of the arrow shaft. The arrow nock which has an open-ended axial cavity for intimately receiving a cooperating end of the adapter therewithin, is also marked with indicia including, at least, a reference line or marker. This key designation is conveniently displaced 90° from a plane represented by the bowstring-receiving slot of the arrow nock. Either or both of the adapter and the arrow nock may carry markers or indicia, arranged or stepped annularly, in addition to the principal reference line provided on each.

In the arrangement described above, as an initial or "starting" orientation, the reference marker on the nock may be juxtaposed precisely opposite or in lineal alignment with the reference marker on the adapter. In this setting the plane correlated with the slot formed in the nock will be at 90° or normal to a plane delineated by the reference vane of the arrow shaft.

In accordance with the practice of the present invention, selectible, controlled and readily reproducible rotational or arcuate displacement, orientation, or annular shifting of the nock with respect to the adapter (and thus with respect to the vane-carrying arrow shaft) is conveniently effected. Rotational repositioning of the arrow nock on the adapter is conveniently carried out. In so doing attention is directed to note each new, realignment or annular displacement as evidenced by visually perceiving the orientation of "opposed" indicia carried by the adapter and the nock. It is apparent that the displacement of the nock with respect to the adapter may be, as desired in either a clockwise or a counterclockwise direction of the rotation or arcuate shift.

Thus, through a methodical and simple experimental "trial" regimen, each archer may arrive at that unique orientation of nock with respect to arrow shaft which, empirically determined, is subjectively best in his (or her) individual case. The orientation may then be quickly and accurately duplicated in each successive arrow prepared for use. A glue or adhesive composition is conveniently applied to the surface of the projecting, nock-receiving end of the adapter just prior to assembly and final, precise arcuate positioning.

Referring now more particularly to the drawing, for purposes of disclosure and not in any limiting sense, a preferred embodiment of the arrow nock orientation assembly 20 of the invention is shown as adapted to function with a conventional arrow shaft 24 to which feathers or vanes 26, 28 and 30 have been affixed in any preferred manner, as by glueing. As illustratively depicted in FIG. 1, vane 26 is the cock feather or reference vane.

In the specific illustrative assembly shown, the arrow is tubular and fabricated of aluminum or of an aluminum or other light weight metal alloy.

Figure 2:
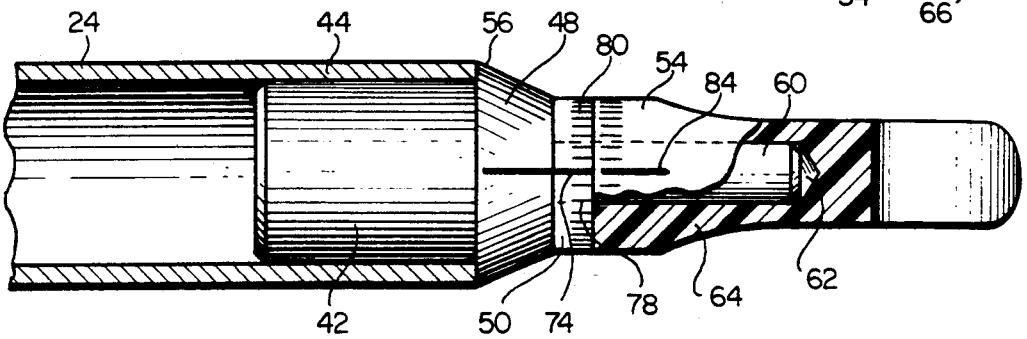
FIG. 2 is a cross-sectional view taken substantially on the lines 2—2 of FIG. 1, and sectioned to show the arrow nock sleeved onto a probe-like end of the adapter of the invention.

As indicated in FIG. 1, and as seen more clearly in FIG. 2, an arrow nock 34 and an adapter 38, interposed between the arrow 24 and the nock 34, complete the assembly 20. In the embodiment of the invention depicted in FIG. 2 the diameter of the arrow shaft 24 is larger than the diameter of the nock 34. To effect accommodation, the adapter 38 is provided with a cylindrical neck or neck portion 42. The latter telescopingly seats, contiguously and tightly within the open end section 44 of the hollow arrow shaft 24.

Spaced rearwardly from the neck 42 of the adapter 34 and joined thereto by an intermediate frusto-conical section 48 is a collar-like band 50. The band 50 has a diameter which is the same as the diameter of the forward end section 54 of the arrow nock 34. The diameter of the frusto-conical section 48, at its forward limit 56, is the same as the outer diameter of the arrow shaft 24, all as shown in FIG. 2.

In the embodiment of the invention illustrated in FIG. 2, the adapter 34 includes a probe-like rod, projection, or coupler 60 of a reduced diameter and extending endwise of the band 50 and rearwardly thereof. The rod 60 is received in mating engagement within a forwardly opening axial bore 62 formed in the body 64 of the nock 34. At its rearward end 66 the nock is formed with a bowstring-receiving slot 70.

Referring further to FIGS. 1 and 2 the adapter 38 is provided with a reference line or marker 74 which appears as a longitudinal scribe or line on the band 50 and which may extend onto the frusto-conical sector 48, for enhancement of ease of perception and identification. As shown, the reference mark or line 74 is aligned with the reference vane or cock feather 26 of the arrow shaft 24. Auxiliary indicia 78 and 80, of lesser intensity, are displayed as arcuately spaced annular arrays or scales on the band 50 at either side the principal marker 74.

Also, as shown in FIGS. 1 and 2, a forward annular zonal ring sector of the end section 54 of the arrow nock 34 is also provided with an axially extending reference marker or line 84. Arrays of annular, spaced secondary indicia 88 and 90 are imprinted on each side of the principal or key marker 84. In the embodiment of the invention depicted, the reference line 84 is in a plane which is normal to a plane defined by the bowstring-receiving slot. As an initial or reference orientation, the principal marker 84 of the arrow of the arrow nock 34 is directly lined up with the principal marker 74 of the fixedly secured adapter 38. Incremental annular rotation of the nock through controlled degrees of arc, in either direction, will establish a different, selectable orientational modal relationship between the bowstring-receiving slot 70 of the nock 34 and the reference vane 26 of the arrow shaft 24. The indicia on either side of the principal markers 74 and 84 facilitate correlating readings of displacements with perceived effects and will also enable one to duplicate or reproduce any annular or arcuate "deviation" ultimately selected as preferred.

Figure 3:
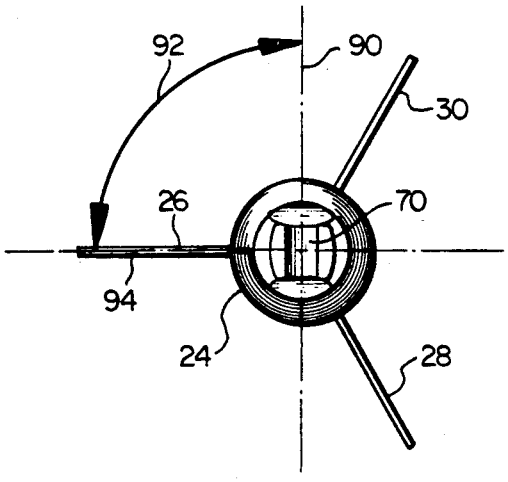
FIG. 3 is an end view of the assembly, from the nock end, and indicating schematically the reference vane at 90° with respect to the plane of the bowstring-receiving slot.
Figure 4:
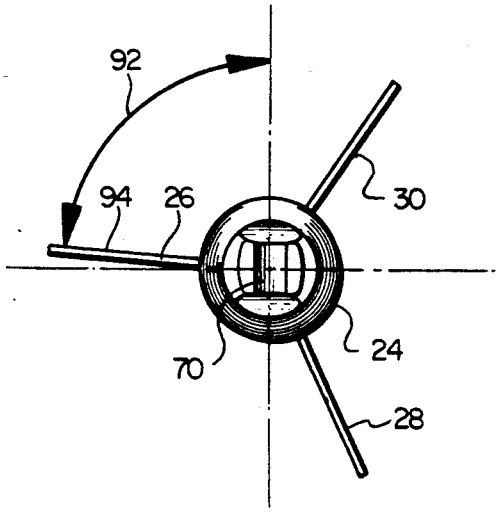
FIG. 4 is a view similar to FIG. 3 but showing the arrow shaft shifted annularly clockwise through a relatively small arc.

FIG. 3 is a schematic representation of the angular relationship between a plane 90 passing upwardly through the bowstring slot 70, and the plane 94 of the reference vane 24, and the planes of the secondary vanes 28 and 30, as in FIGS. 1 and 2. The arc 92 between the plane 90 and the plane 94 is 90 degrees. FIG. 4 is schematic representation showing a small deviation (in this case a reduction) from the 90 degree relationship between the plane of the bowstring slot 70 and the reference vane 26 upon rotating the arrow shaft 24 clockwise, as viewed from the end 66 of the arrow nock 34, a selectable small increment of arc. Rotation of the arrow shaft 24 counter clockwise would generate an arc 98 which is somewhat greater than 90 degrees. Each variation is a viable option. Each may, in a given case, constitute a "correction" effective to enhance true trajectory or arrow shaft flight for a particular archer.

A second embodiment of the invention is illustrated in FIGS. 5 and 6. As shown, the arrow shaft **24*a* and the arrow nock have the same diameter. As in the first embodiment, the adapter 38*a* has a cylindrical neck 42*a* which is sleeved and secured in the open end of the hollow arrow shaft 24*a*. The plane of the bowstring-receiving slot 70*a* is normal to a plane in which the principal reference lines 74*a* and 84*a* lie. The latter are shown in registry and in alignment with the cock feather or reference vane 26***a* of the shaft 24*a*. Additional orientation indicia in the form of annular arrays of arcuately spaced markers 78*a*, 80*a* and 90*a*, etc. are shown. As in the embodiment depicted in FIGS. 1 and 2, adapter 34*a* of FIGS. 5&6 is formed with a rearwardly projecting probe-like rod 60*a* which is matingly received in a forwardly opening tubular bore 62*a* in the nock 34*a*. In the final configuration of the assembly 20*a*, the rod 60*a* is adhesively bonded in its ultimately selected orientational mode.

The embodiment of the invention shown in FIG. 7 is, in substantially all material respects, essentially the same as the structure depicted in FIGS. 5 and 6. A principal difference is that the position 102 of the adapter 38*b* which extends rearwardly and is embraced within the arrow nock 34*a* is a frusto-conical section terminating in a shortened stub-like cylindrical end 104. The nock 34*b* is shaped internally nestingly to accommodate the penetrating portions 102 and 104 of the invasive adapter 38*b*, as indicated in the drawing.

What is claimed is:

1. In combination with an arrow shaft assembly including a shaft having a cock feather or reference vane fixed thereto and extending therealong, and in which said arrow shaft terminates in an arrow nock with a bowstring-receiving slot formed therein;

reference means for adjustably and reproducibly establishing a selectable, predetermined, annular orientational modal disposition of said bowstring-receiving slot of said arrow nock with respect to said reference vane of said arrow shaft;

said reference means comprising adapter means coaxial with and interposed lineally between and intercoupling said arrow shaft with said nock, means for securing said adapter means to said shaft against axial separation from and against rotational displacement relative thereto, an arrow nock for attachment to said adapter means coaxially therewith, collar-like band means encircling said adapter means in an annular zone abutting said shaft, marker means and reference index means carried on said adapter means and on said nock, scale indicia means for establishing selectable relative annular positioning of said arrow nock with respect to an annular reference position delineated by said reference vane on said arrow shaft.

2. The combination as set forth in claim 1 wherein said arrow nock is slideably sleeved onto said adapter means and rotatable with respect thereto.

3. The structure as set forth in claim 1 wherein said adapter means includes a circumscribing, radially inwardly tapered lineal zone extending rearwardly of said shaft, and wherein said nock is formed with an elongate open-ended cavity having bounding walls for positive embracing abutment against said tapered zone of said adapter means seated therewithin for contiguous mating engagement of said nock with said adapter means.

4. The structure as set forth in claim 3 wherein said adapter means is formed with a rod-like end probe projecting rearwardly thereof, and wherein said nock is formed with a forwardly-opening axially-extending bore for sleevedly and matingly receiving said end probe of said adapter means therewithin, and wherein said nock is rotatable coaxially with respect to said adapter means to establish a selectable annular orientational relationship between said slot in said nock and a reference vane of said arrow shaft.

5. The structure as set forth in claim 1 wherein said adapter means is formed with a reduced-diameter neck extending forwardly thereof and sized for matingly seating within an open cooperating encircling collar-like end of said arrow shaft.

6. The structure as set forth in claim 5 wherein said adapter is formed with a forwardly positioned zonal section which is radially flush with an adjacent said collar-like end of said arrow shaft.

7. The structure as set forth in claim 1 wherein said nock includes an orientational reference mark which is displaced 90 degrees from a plane defined by said slot in said nock.

8. The structure as set forth in claim 1 wherein said adapter means is integrally formed with a rearwardly directed shaft projecting axially thereof, and wherein said nock is formed with a forwardly opening axial bore sized for matingly receiving said shaft therewithin for coupling said nock to said adapter means.

9. The structure as set forth in claim 8 wherein said nock is rotatable about shaft coaxially therewith for selective annular positioning with respect to an arrow-shaft-carried reference vane.

10. The structure as set forth in claim 1 and further comprising adhesive means for bonding said nock to said adapter means to prevent relative rotation therebetween and to preserve a selectable orientational relationship between said nock and said reference vane.

11. The combination as set forth in claim 1 wherein said adapter means and said nock both carry marker indicia, wherein indicia on said adapter means include a fixed reference marker aligned with said reference vane, wherein said indicia on said nock include a rotatable marker which is located at 90 degrees with respect to a plane delineated by the bowstring-receiving slot of the arrow nock whereby, for facilitating an initial optional orientational setting in which the bowstring groove extends in a plane which is at 90 degrees with respect to said reference vane of the arrow shaft, it is necessary merely rotationally to align said rotatable marker on said nock with said fixed marker on said adapter means.

* * * * *